US005443327A

United States Patent [19]

Akkala et al.

[11] Patent Number: 5,443,327

[45] Date of Patent: Aug. 22, 1995

[54] METHOD AND APPARATUS FOR FORMING A LINED TRENCH

[75] Inventors: Steven M. Akkala; Andy Aylward, both of Neenah; Tim J. Koller, Winneconne, all of Wis.

[73] Assignee: Neenah Foundry Company, Neenah, Wis.

[21] Appl. No.: 196,306

[22] Filed: Feb. 15, 1994

[51] Int. Cl.[6] ..... E02B 5/00

[52] U.S. Cl. ..... 405/118; 210/164; 404/4; 405/119

[58] Field of Search ..... 405/36, 118, 119, 121–123; 210/163, 164; 404/2, 3, 4

[56] References Cited

U.S. PATENT DOCUMENTS

| | | |
|---|---|---|
| 2,843,913 | 7/1958 | Barron . |
| 2,917,804 | 12/1959 | Barron . |
| 3,225,545 | 12/1965 | Flegel . |
| 4,472,078 | 9/1984 | Karbstein . |
| 4,553,874 | 11/1985 | Thomann et al. . |
| 4,640,643 | 2/1987 | Williams . |
| 4,787,773 | 11/1988 | Kehler . |
| 4,844,655 | 4/1989 | Aleshire . |
| 4,993,877 | 2/1991 | Beamer . |
| 4,993,878 | 2/1991 | Beamer . |
| 5,052,654 | 10/1991 | Means et al. . |
| 5,066,165 | 11/1991 | Wofford et al. . |

OTHER PUBLICATIONS

Zurn Industries, Inc., "Flo Thru Pre-Sloped Drainage System", 1993, four (4) pages of literature.

L. M. Scofield Company, "Precast Interconnecting Drainage Systems", 1986, four (4) pages of literature.

Construction Casting Company, Inc., "E-Z Frame Installation Sheet & General Trench Forming Procedures (One Suggested Method)", 1990, four (4) pages of literature.

Quazite Polycast a division of MMFG, "Presloped Surface Drain System", date unknown, two (2) pages of literature.

Your Source, Inc., "Polydrain The Simple Solution to Surface Drainage", date unknown, pp. 1, 7, 9, 17, 19, 21, and 29 of the Design Professional Manual.

*Primary Examiner*—David H. Corbin

*Attorney, Agent, or Firm*—Ryan, Kees & Hohenfeldt

[57] ABSTRACT

A reusable support structure for installing a trench liner in a trench formed in the ground, and a method for doing so. The support structure includes a crossbar having two ends and spanning the trench. The top end of a threaded rod is adjustably connected to the crossbar by a nut threaded onto the rod above the crossbar. The bottom end of the threaded rod is connected to the bottom or floor portion of the liner by a nut threaded onto the rod below the bottom floor portion of the liner, the threaded rod thus passing through the liner floor. A plurality of these trench liners are installed in the trench, and are connected together by one or more tabs at one end of each trench liner that coact with the opposite end of the next adjacent trench liner to connect the two trench liners together. The top nut then rests on the crossbar, supporting the rod, and in turn the trench liner, at the proper height in the trench, the height being adjustable by turning the nut. Next, some paving material is poured into the gap between the liner and the trench. The crossbars, threaded rods and top nuts are then removed for reuse, leaving only the bottom nuts underneath the trench liners. Paving material is then again added to bring the trench up to grade.

17 Claims, 1 Drawing Sheet

METHOD AND APPARATUS FOR FORMING A LINED TRENCH

BACKGROUND OF THE INVENTION

This invention relates to a liner system for an open-top trench, and to apparatus and methods for installing such a trench liner system.

There have in the past been a number of trench systems and apparatus for installing them. Each such system and apparatus, however, has been plagued by problems. One type of problem common in trench systems and apparatus for installing them is that the support structure used for installation of the trench liner cannot be re-used, but must be sacrificed with each installation. Examples of structures with this problem include Kehler, U.S. Pat. No. 4,787,773, and two patents to Beamer, U.S. Pat. Nos. 4,993,877 and 4,993,878. In each of those patents, it is required to leave behind the supporting structure, or to destroy most or all of the form members used to form the trench in removing them and finishing the construction project. In Aleshire, U.S. Pat. No. 4,844,655, the support structure is said to be removable, but such removal requires pulling steel rods out of set concrete, a task that is much more difficult than it is made to appear in that patent.

This invention relates to improvements over the methods and apparatus set forth above and to solutions to the problems raised or not solved thereby.

SUMMARY OF THE INVENTION

The present invention relates to a reusable support structure for installing a trench liner in a trench formed in the ground. The trench has trench walls spaced apart a predetermined distance, which is the trench width, and a bottom trench floor portion. The reusable support structure properly locates the trench liner in the trench. The trench liner is provided in sections. Each section of trench liner has spaced apart liner side walls and a bottom liner floor portion. The support structure includes a crossbar having two ends and spanning the trench, those two ends supported by the surface of the ground. The top end of a threaded rod is adjustably connected to the crossbar by a nut threaded onto the rod above the crossbar. The bottom end of the threaded rod is connected to the bottom floor portion of the liner by a nut threaded onto the rod below the bottom floor portion of the liner, the threaded rod thus passing through the bottom floor portion of the liner. A plurality of these trench liner sections is installed in the trench, and are connected together by one or more tabs at one end of each trench liner section that coact with the opposite end of the next adjacent trench liner section to connect the two trench liner sections together, at a "joint". Control blocks are placed between the crossbar and the top edge of the trench liner, positioned at the joint 43 (FIG. 2) between two adjacent trench liner sections, to stabilize the joint and assure a level joint between sections. The above described nuts are then tightened to rigidly hold the liner sections together.

The invention also includes a method for forming a lined trench in the ground. The method includes digging the trench With a predetermined width, depth and length. The threaded rod is connected at its top end, one to each of the crossbars. The connection is made at the top end of the rod by inserting the rod through the crossbar and threading a top nut onto the rod. The bottom of each threaded rod is connected to the bottom floor portion of the trench liner by inserting it through a hole in the bottom of the trench liner and threading it into the nut underneath the trench liner. The trench liner section is then placed in the trench, with the crossbars placed in spanning position on the trench. The top nut then rests on the crossbar, supporting the rod, which in turn supports the trench liner, on the bottom nut, at the proper height in the trench. With the control blocks positioned between the crossbars and the trench liner, as described above, the nuts are then tightened to rigidly hold the liner sections together. The height of the trench liner is thus fixed to a predetermined height with respect to the trench. Next, paving material is poured into the gap between the liner and the trench. This paving material can be poured completely to finished grade, or poured only partially. After the paving material is set, the crossbars, threaded rods and top nuts are removed for reuse, leaving only the bottom nuts underneath the trench liners. If the paving material was only partly poured in the first pour, an additional pour to finished grade is required.

Other objects and advantages of the invention will become apparent hereinafter.

DESCRIPTION OF THE PREFERRED EMBODIMENT

Figure 1:
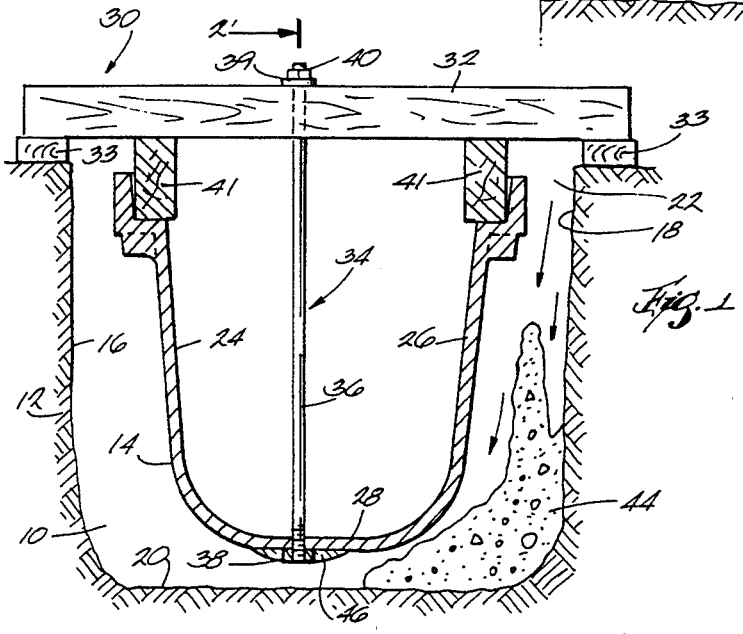
FIG. 1 is a cross sectional view of an apparatus constructed according to a preferred embodiment of the invention.

Referring now to FIG. 1 there is shown a trench 10 formed in the surface of the ground 12. The trench 10 of course will have two side walls 16, 18 spaced apart a certain distance, and a floor 20 at the bottom, a certain distance below the surface of the ground 12. The distance between the side walls 16, 18 is of course the width of the trench 10, while the distance of the floor 20 below surface of the ground 12 is the depth of the trench. Both the width and depth of the trench 10 must be large enough to easily accommodate trench liner 14, with additional space around the trench liner to permit a gap 22 for the later addition of paving material as will be explained presently.

According to the invention, a number of sections of trench liner 14 are positioned in trench 10, for the length of the trench. Each section of trench liner 14 includes two Side walls 24, 26 separated a predetermined distance depending on the specifications and details of the particular job, that distance determining the width of the trench liner. Integrally connecting the bottom ends of the side walls 24, 26 is a bottom liner floor portion 28. It is assumed that trench liner section 14 is formed of a single casting, of a material such as cast iron, although there are of course other acceptable ways and materials for forming the trench liner.

According to the invention, each of the trench liner sections 14 is supported in trench 10 by a support structure 30. The support structure 30 includes at least one crossbar 32, which spans the trench 10. Preferably two crossbars 32 will be provided, one near each end of each trench liner section 14. From each crossbar 32 there is removably and adjustably attached and suspended a support column 34, which in turn suspends and is removably attached to the bottom liner floor portion 28 of the trench liner 14. In the most preferred embodiment, support column 34 includes a threaded rod 36, the bottom end of which is passed through the bottom liner floor portion 28 of trench liner 14, and a nut, bottom nut 38, is threaded onto the rod from beneath the liner. To facilitate later removal, as will be explained presently, the threaded rod 36 should not extend past the bottom nut 38. Similarly, the top end of the threaded rod 36 is passed through the crossbar 32, and a washer 39 and a nut, top nut 40, are applied to the rod. The top nut 40 and washer 39 thus rest on top of the crossbar 32, and the liner 14 rests on the bottom nut 38.

This support structure 30 can be helpful in installing the trench liner 14 in the trench 10. That is, the support structure 30 may be first attached to the trench liner 14, and the liner may then be carried by the support structure to the trench 10, and lowered therein.

Figure 3:
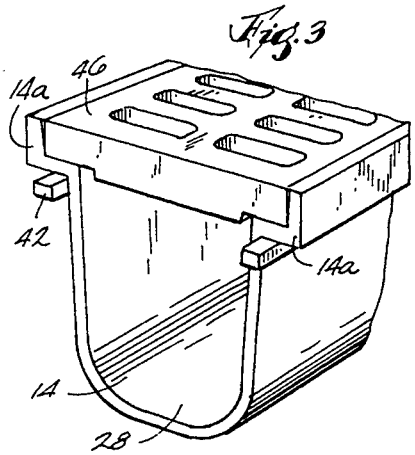
FIG. 3 is a perspective view of a trench liner and grate according to a preferred embodiment of the invention.
Figure 2:
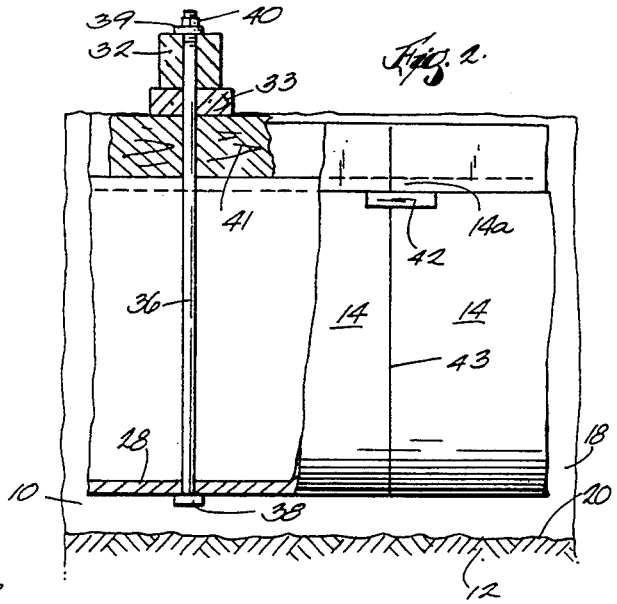
FIG. 2 is a cross sectional view of the apparatus shown in FIG. 1, taken generally along line 2—2.

In order to aid in alignment and connection of successive trench liner sections 14, each trench liner is also provided with a pair of control tabs 42, shown best in side view in FIG. 2 and in perspective view in FIG. 3. These control tabs 42 are provided at one end only of each section of trench liner 14, and protrude longitudinally beyond the end of the liner, just below a grate support ledge 14a near the top of the liner, to coact with the opposite end of the next adjacent trench liner. Thus, as the liner 14 is lowered into the trench by lowering the support structure 30, the control tabs 42 of the next adjacent liner section, already installed, provide support and aid in alignment of the liner section being installed. The vertical position of the trench liner 14 should be such that the top of the liner is just below the surface of the ground 12, and so that the bottom liner floor portion 28 of the trench liner is suspended above the floor 20 of the trench. Further, the individual trench liner sections 14 are supported with respect to each other in such a way as to permit efficient flow of liquid from one section to the next along the length of the trench, that is, so that the bottom liner floor portion 28 of each section is quite well aligned with the floor portions of adjacent sections.

As the support structure 30 and trench liner 14 are lowered into the trench 10, the ends of the crossbars 32 may come to rest directly on the top surface of the ground 12. The preferable arrangement, however, is for the ends of the crossbars 32 to rest on support blocks 33 which in turn rest on the ground. The support blocks 33 provide the installer with additional flexibility in the installation.

Once the trench liner section 14 is positioned in the trench 10, a pair of control blocks 41 are placed between each crossbar 32 and the grate support ledge **14*a* of the trench liner, positioned at the joint between two adjacent trench liner sections, to stabilize the joint and assure a level joint between sections. The nuts 38, 40** are then tightened to rigidly hold the liner sections together.

The use of nuts 38, 40 and threaded rod 36, and control blocks 41 of various thicknesses, enable the installer to make extremely fine adjustments of the height of any one particular trench liner section 14 with respect to the trench 10, or the ground 12, or adjacent trench liner sections, to assure proper drainage of any liquids from one liner into the next successive liner, throughout an entire drainage system.

Once the trench liners 14 are installed in the trench 10 as shown in FIGS. 1 and 2, and the height adjusted as desired, paving material 44, such as concrete or other suitable paving material, is poured into the trench, in the gap 22 between the wall of the trench and the liner. The top surface of the final stage of paving material 44 should be angled slightly downward from the top surface of the ground 12 to the top of the liner 14, to assure proper drainage into the liner. Once the paving material 44 is set, the threaded rod 36 can be easily removed from bottom nut 38, and the rest of the support structure 30 removed and reused, sacrificing only that bottom nut.

Figure 4:
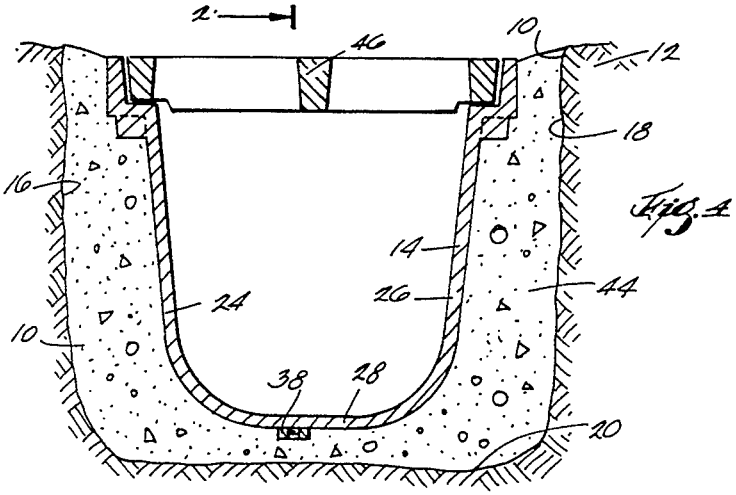
FIG. 4 is a cross sectional view similar to FIG. 1, with the installation apparatus removed, only the trench liner and bottom nut remaining, and with the grate installed.

The paving material 44 may be poured in stages, or may be poured all at once. If the paving material is poured in two or more stages, the support structure 30 may be more easily removed after the first stage is poured and set. Also, finishing of the concrete is made substantially easier if the last pour is after removal of the support structure 30. Accordingly, staged pouring is preferred. As can be understood at this point, the reason the threaded rod 36 should not extend beyond the nut 38 is that it would be more difficult to remove if the rod extended into the paving material 44 and was to be removed after the paving material had set. Thereafter, the grate 46 (FIGS. 3 and 4) is installed in the grate support ledge **14*a* of the liner 14**, and the trench system is ready to catch and convey liquids.

The crossbar 32, support blocks 33 and control blocks 41 may be of any suitable material, and the inventors have successfully used common wooden construction two-by-fours as materials for these items.

In one embodiment, a recess 48 (FIG. 1) may be formed in the bottom surface of the trench liner 14 surrounding the hole through which the threaded rod 36 is passed. This recess 48 is formed and shaped to hold the bottom nut 38 from turning when the threaded rod is tightened into it.

While the apparatus hereinbefore described is effectively adapted to fulfill the aforesaid objects, it is to be understood that the invention is not intended to be limited to the specific preferred embodiment of method and apparatus for forming a lined trench set forth above. Rather, it is to be taken as including all reasonable equivalents to the subject matter of the appended claims.

We claim:

1. A reusable support structure for installing a trench liner in a trench formed in the top surface of the ground, the trench having an open top, trench walls spaced apart a predetermined trench width distance, and a bottom trench floor portion, said structure properly locating the trench liner in the trench, the trench liner having spaced apart liner side walls and a bottom liner floor portion, said support structure comprising:

a crossbar spanning the trench, and supported by the top surface of the ground;

a support column adjustably connected at its top to the crossbar, and removably connected at its bottom to the bottom liner floor portion, for supporting the liner with respect to the trench, the support column including for adjusting the height of the trench liner over the bottom trench floor portion.

2. The combination of a trench liner having spaced apart liner side walls and a bottom liner floor portion, for placement in an open-top trench formed in the ground, and a reusable supporting structure, comprising a crossbar spanning the trench and supported by the ground, and a support column, the top of the support column adjustably connected to the crossbar, and the bottom of the support column removably connected to the bottom floor portion of the trench liner, for supporting the liner with respect to the trench, the support column including means for adjusting the height of the trench liner with respect to the trench.

3. A reusable support structure for installing a trench liner in a trench formed in the top surface of the ground, the trench having trench walls spaced apart a predetermined trench width distance, and a bottom trench floor portion, the reusable support structure properly locating the trench liner in the trench, the trench liner having spaced apart liner side walls and a bottom liner floor portion, the support structure comprising:

a crossbar having two ends and spanning the trench, those two ends supported by the ground;

a threaded rod adjustably connected at its top to the crossbar, and removably connected at its bottom to the bottom floor portion of the trench liner, for supporting the liner with respect to the trench, with the ability to adjust the height of the trench liner with respect to the bottom trench floor portion.

4. A reusable support structure as recited in claim 3 wherein the bottom end of the threaded rod is connected to the bottom floor portion of the liner by a nut threaded onto the rod below the bottom floor portion of the liner, the threaded rod thus passing through the bottom floor portion of the liner.

5. A reusable support structure as recited in claim 4 wherein the top end of the threaded rod is connected to the crossbar by a nut threaded onto the rod above the crossbar.

6. The combination of a plurality of trench liner sections, each such section having a pair of spaced apart liner side walls and a bottom liner floor portion, for placement in an open-top trench formed in the ground, and a reusable supporting structure, comprising a plurality of crossbars spanning the trench and supported by the ground, and a plurality of support columns, the top of each support column adjustably connected to one of the crossbars, and the bottom of the support column removably connected to the bottom floor portion of one of the trench liners, for supporting the liners with respect to the trench, the support column including means for adjusting the height of the trench liners with respect to the trench.

7. A combination as recited in claim 6 wherein the trench liners are connected together.

8. A combination as recited in claim 6 wherein the trench liners are connected together by one or more tabs at one end of each trench liner that coact with the opposite end of the next adjacent trench liner to connect the two trench liners together.

9. A method for forming a lined trench in the ground, comprising:

digging a trench of a predetermined width, depth and length;

placing a trench liner, having a pair of spaced apart liner side walls and a bottom liner floor portion, into the trench;

placing a plurality of crossbars in spanning position on the trench along the length thereof;

connecting a support column at its top end to each of the crossbars, and connecting the bottom of the support column to the bottom floor portion of the trench liner, thereby supporting the liner with respect to the trench and forming a gap between the liner and the trench;

adjusting the height of the trench liner to a predetermined height with respect to the trench;

pouring paving material into the gap between the liner and the trench; and removing the crossbars and support columns, for reuse.

10. A method as recited in claim 9 wherein the support column is a threaded rod, and wherein the top end of the rod is connected to the crossbar by a nut threaded onto the rod and resting on the crossbar.

11. A method as recited in claim 9 wherein the support column is a threaded rod, and wherein the bottom end of the rod is connected to the trench liner by a nut threaded onto the rod, with the trench liner resting on the nut.

12. A method as recited in claim 9:

wherein the support column is a threaded rod, wherein the top end of the rod is connected to the crossbar by a top nut threaded onto the rod and resting on the crossbar; and wherein the bottom end of the rod is connected to the trench liner by a bottom nut threaded onto the rod, with the trench liner resting on the nut;

the top nut being removed with the crossbar and support column, for reuse, after the pouring step.

13. A method for forming a lined trench in the ground, comprising:

digging a trench of a predetermined width, depth and length;

connecting a support column at its top end to each of a plurality of crossbars, and connecting the bottom of the support column to the bottom floor portion of a trench liner section, said liner section having a pair of spaced apart liner side walls and a bottom liner floor portion;

positioning the crossbars in spanning position over the trench, thereby supporting the liner section with respect to the trench and forming a gap between the liner and the trench;

adjusting the height of the trench liner to a predetermined height with respect to the trench;

pouring paving material into the gap between the liner and the trench; and removing the crossbars and support columns, for reuse.

14. A method as recited in claim 13 wherein the support column is a threaded rod, and wherein the top end of the rod is connected to the crossbar by a nut threaded onto the rod and resting on the crossbar.

15. A method as recited in claim 13 wherein the support column is a threaded rod, and wherein the bottom end of the rod is connected to the trench liner by a nut threaded onto the rod, with the trench liner resting on the nut.

16. A method as recited in claim 13 wherein the step of pouring paving material involves only pouring part of the necessary paving material, and further comprising a second pouring step, after the step of removing the crossbars and support columns, in which second pouring step additional paving material is added to fill the trench substantially to grade.

17. A method as recited in claim 13:

wherein the support column is a threaded rod, wherein the top end of the rod is connected to the crossbar by a top nut threaded onto the rod and resting on the crossbar; and wherein the bottom end of the rod is connected to the trench liner by a bottom nut threaded onto the rod, with the trench liner resting on the nut;

the top nut being removed with the crossbar and support column, for reuse, after the pouring step.

* * * * *